US012660906B2

(12) United States Patent
Cox et al.

(10) Patent No.: US 12,660,906 B2
(45) Date of Patent: Jun. 23, 2026

(54) COSMETIC CASE

(71) Applicant: Beauty Molecules International Limited, London (GB)

(72) Inventors: Natalie Cox, Dubai (AE); Ralph Chami, Dubai (AE); Audrey Bois Nicolai, Dubai (AE); Cecile Boyer, Dubai (AE); Celine Talabaza, Madrid (ES)

(73) Assignee: Beauty Molecules International Limited, London (GB)

( * ) Notice: Subject to any disclaimer, the term of this patent is extended or adjusted under 35 U.S.C. 154(b) by 105 days.

(21) Appl. No.: 18/806,948

(22) Filed: Aug. 16, 2024

(65) Prior Publication Data

US 2026/0047660 A1 Feb. 19, 2026

(51) Int. Cl.

| | |
|---|---|
| ***A45D 40/00*** | (2006.01) |
| ***B65D 25/10*** | (2006.01) |
| ***B65D 43/16*** | (2006.01) |

(52) U.S. Cl.

CPC ..... *A45D 40/0087* (2013.01); *B65D 25/108* (2013.01); *B65D 43/164* (2013.01)

(58) Field of Classification Search

CPC ..... B65D 77/0446; B65D 77/0453; B65D 2313/04; B65D 25/108; B65D 43/164; A45D 40/0087

USPC ..... 206/373, 581, 818, 823, 6.1, 350, 449, 206/45.23, 455–456, 486, 557–558, 563, 206/765; 220/23.4, 230, 528, 23.88, 523, 220/553, 836; 132/294, 315, 293, 314; 224/183; 248/683, 206.5; 24/303

See application file for complete search history.

(56) References Cited

U.S. PATENT DOCUMENTS

| | | | | |
|---|---|---|---|---|
| 457,598 A * | 8/1891 | Briggs | ..... | B65D 5/5206 206/45.28 |
| 1,262,963 A * | 4/1918 | McCrea | ..... | A61F 15/001 206/440 |
| 1,456,613 A * | 5/1923 | Bartels | ..... | A47F 7/03 206/734 |

(Continued)

FOREIGN PATENT DOCUMENTS

| | | |
|---|---|---|
| CN | 106794930 A | 5/2017 |
| WO | 2009119230 A1 | 10/2009 |

OTHER PUBLICATIONS

PCT/EP2024/083581, Filing Date Nov. 26, 2024 Corresponding to current US Application; Search Report May 26, 2025.

*Primary Examiner* — Orlando E Aviles
*Assistant Examiner* — Brijesh V. Patel
(74) *Attorney, Agent, or Firm* — Adam K. Sacharoff; Much Shelist, PC

(57) ABSTRACT

A cosmetic case for holding at least one sachet. The case includes a base with front and rear portions, and exterior surface walls extending from a bottom member to form an interior hollow section. A lid is connected to the base by a hinge. A bottom insert is positioned within the hollow section and secured to the bottom member. A removable body insert, secured within the base, has a lower and slanted upper section connected by side sections, with multiple channels for removable cosmetic sachets. An inner cap, secured within the lid, includes a well and a closure mechanism to maintain the lid closed or allow it to open. A defined gap in the front of the case facilitates opening the lid.

18 Claims, 16 Drawing Sheets

(56) References Cited

U.S. PATENT DOCUMENTS 2,046,133 A * 6/1936 Rathbun ..... B65D 43/168 220/829
2,775,342 A * 12/1956 Smith ..... B25H 3/003 206/755
2,889,036 A * 6/1959 Davies ..... B42D 17/00 40/489
3,074,539 A * 1/1963 Rogovin ..... B25H 3/003 206/379
3,342,190 A * 9/1967 Hultgren ..... A45D 40/22 220/840
3,710,900 A * 1/1973 Fink ..... A45C 13/02 190/110
3,710,977 A * 1/1973 Van den Enden ..... G03B 17/26 206/455
3,850,296 A * 11/1974 Hirata ..... B65D 43/02 211/41.18
4,375,850 A * 3/1983 Smyth ..... G11B 23/023 206/464
4,448,303 A * 5/1984 Beckenfeld ..... B65D 5/524 206/45.3
4,541,527 A * 9/1985 Nagel ..... G11B 33/0433 206/265
4,589,430 A * 5/1986 Sussman ..... A45D 40/22 132/294
4,629,066 A * 12/1986 Howard ..... G11B 23/0236 190/110
4,695,103 A * 9/1987 MacDonald ..... G11B 33/0438 312/193
4,733,794 A * 3/1988 Kent ..... B65D 43/162 220/826
4,779,756 A * 10/1988 Buelens ..... B65D 43/162 206/408
4,807,753 A * 2/1989 Goldstein ..... B65D 85/672 206/390
D300,095 S * 3/1989 Robinson ..... D6/682.4
4,821,751 A * 4/1989 Chen ..... A45D 33/24 206/823
4,826,007 A * 5/1989 Skeie ..... A63H 33/30 220/524
4,880,139 A * 11/1989 Jumel ..... A45D 40/221 206/581
4,889,232 A * 12/1989 Asleson ..... B65D 25/107 D9/423
4,905,867 A * 3/1990 Claassen ..... B65D 83/00 221/250
4,927,016 A * 5/1990 Fuller ..... A45C 13/02 206/315.11
4,964,526 A * 10/1990 Stephens ..... A45C 13/02 206/823
5,005,697 A * 4/1991 Jimbo ..... A45C 13/02 206/823
5,022,529 A * 6/1991 Kang ..... A45D 40/22 206/581
5,107,871 A * 4/1992 Butcher ..... A45D 40/22 206/823
5,135,012 A * 8/1992 Kamen ..... A45C 13/02 206/823
5,139,165 A * 8/1992 Hara ..... B65D 25/106 220/839
5,301,808 A * 4/1994 Pierson ..... A45D 40/24 132/297
5,330,056 A * 7/1994 de la Rocha ..... B65D 5/5088 206/229
5,338,108 A * 8/1994 Hunt ..... G11B 33/0433 312/9.14
5,351,812 A * 10/1994 Eagon ..... B44D 3/04 220/230
5,353,947 A * 10/1994 Zinnbauer ..... A45D 40/22 D28/83
5,353,956 A * 10/1994 Wilson ..... A45D 40/02 426/115
5,368,164 A * 11/1994 Bennett ..... B25H 3/06 206/379
5,441,153 A * 8/1995 Lahaye ..... A45C 15/04 206/823
5,547,072 A * 8/1996 Kaiser ..... B65D 43/24 206/6.1
5,562,208 A * 10/1996 Hasler ..... B25F 1/00 206/373
5,570,784 A * 11/1996 Sidabras ..... B25H 3/003 206/378
5,605,167 A * 2/1997 Montoli ..... A45C 13/02 132/294
D412,279 S * 7/1999 Brice ..... D7/629
5,938,031 A * 8/1999 Woods ..... G03D 15/001 206/455
6,019,225 A * 2/2000 Kalmakis ..... B01L 9/543 211/74
6,105,767 A * 8/2000 Vasudeva ..... B25H 3/023 206/349
D449,782 S * 10/2001 Diaz ..... D7/629
6,305,543 B1 * 10/2001 Lafond ..... G02B 21/34 206/561
D471,804 S * 3/2003 Staples ..... D9/423
D477,896 S * 7/2003 Weiss ..... D28/85
6,612,454 B1 * 9/2003 Lin ..... B65D 77/0453 220/23.88
D480,561 S * 10/2003 Simon ..... D7/629
6,691,905 B2 * 2/2004 Berdan ..... A63B 57/0032 224/183
6,709,684 B2 * 3/2004 Loth ..... B65D 43/162 206/800
6,831,541 B1 * 12/2004 Seidler ..... H01F 7/0263 206/818
6,868,967 B2 * 3/2005 Lam ..... A45C 13/02 206/372
6,925,739 B1 * 8/2005 Cole ..... G09D 3/04 40/120
D516,422 S * 3/2006 Willson ..... D9/432
7,017,744 B2 * 3/2006 Persson ..... A61B 50/37 206/440
7,047,983 B2 * 5/2006 Manougian ..... A45D 40/22 220/592.2
7,228,966 B1 * 6/2007 Turner ..... A45D 40/24 206/385
7,246,704 B2 * 7/2007 Brunson ..... B25H 3/003 220/23.88
7,357,250 B2 * 4/2008 Hagemann ..... A01K 97/06 206/315.11
7,467,440 B2 * 12/2008 Seidler ..... B65D 51/04 16/320
7,762,426 B2 * 7/2010 Stevens ..... B65D 43/162 221/154
7,806,264 B1 * 10/2010 Lai ..... B25H 3/003 206/375
8,297,443 B2 * 10/2012 Ogando ..... B65D 5/4208 206/45.23
8,336,708 B2 * 12/2012 Potterfield ..... B25H 3/02 206/459.5
8,336,712 B2 * 12/2012 Holstein ..... A61F 15/002 221/133
9,027,749 B2 * 5/2015 Hill ..... A47K 10/00 220/827
9,179,756 B2 * 11/2015 Weinberg ..... A45C 11/00
D756,036 S * 5/2016 Heilman ..... D28/76
9,796,076 B2 * 10/2017 Baruch ..... B25H 3/023
9,955,773 B1 * 5/2018 Tavella ..... A47G 29/08
10,654,042 B2 * 5/2020 Rethwisch ..... B65D 25/108
10,882,661 B1 * 1/2021 Seidler ..... A45D 40/24
11,103,989 B2 * 8/2021 Hurley ..... H01F 7/0252
11,278,131 B2 * 3/2022 Nunez ..... B65D 25/108
2005/0023183 A1 * 2/2005 Banik ..... B65D 77/0486 206/581
2006/0027593 A1 * 2/2006 Slocum ..... G09F 3/203 221/232
2006/0180596 A1 * 8/2006 Young ..... A47K 10/423 221/63

(56) References Cited

U.S. PATENT DOCUMENTS

| | | | | |
|---|---|---|---|---|
| 2006/0238280 | A1* | 10/2006 | Libohova | F16F 6/005 |
| 2007/0063004 | A1* | 3/2007 | Weinberg | B65D 21/0208 229/120.01 |
| 2009/0065374 | A1* | 3/2009 | Au | A45C 11/10 206/459.5 |
| 2010/0276313 | A1* | 11/2010 | Nakano | B65D 85/1081 206/268 |
| 2010/0307530 | A1* | 12/2010 | Bennett | A45D 33/16 132/307 |
| 2013/0133686 | A1* | 5/2013 | Shteysel | A45D 33/22 29/428 |
| 2015/0166248 | A1* | 6/2015 | Wichmann | B65D 43/162 206/449 |
| 2015/0298895 | A1 | 10/2015 | Corbett et al. | |
| 2016/0121478 | A1* | 5/2016 | Schein | B25H 3/06 206/350 |
| 2017/0156472 | A1* | 6/2017 | Lin | A45D 33/003 |
| 2018/0042209 | A1* | 2/2018 | Aston | A01K 83/00 |
| 2018/0263361 | A1* | 9/2018 | Langdon | A45D 33/20 |
| 2019/0075910 | A1* | 3/2019 | Torres | A45D 40/24 |
| 2021/0100333 | A1* | 4/2021 | Seidler | A45C 13/1069 |
| 2022/0125181 | A1 | 4/2022 | Charlot et al. | |
| 2022/0346522 | A1* | 11/2022 | Cheng | A45D 33/24 |
| 2022/0409350 | A1* | 12/2022 | Vaughn | A61C 19/008 |

* cited by examiner

COSMETIC CASE

FIELD OF THE INVENTION

The present invention relates to small handheld case, and more particularly to a Cosmetic Case that allows the user to remove single dose applicator sachets.

BACKGROUND OF THE INVENTION

Small cosmetic cases are well known in the industry. However, there is always a need to design and create unique cosmetic cases specifically engineered to solve a purpose. As opposed to a cosmetic case that contains an open cosmetic, which can dry out or spill. As such, the industry has developed cosmetic cases to hold pre-packaged single dose sachets. These sachets can contain applicators, wipes, or creams used on the face or hands and then discarded. However, the cases holding these single sachets are often not user friendly and do not easily allow for the refilling of the single doses. Therefore, there is a need over the prior art to an invention that is capable of providing a easy to use, easy to refill cosmetic case.

SUMMARY OF THE INVENTION

In one embodiment of the present invention there is provided a cosmetic case for holding at least one sachet. The case includes a base with front and rear portions, along with exterior walls that create an interior hollow section. A lid, connected to the base by a hinge, provides a secure closure for the case. Within the base, a bottom insert is positioned and secured, featuring a flat top with indented sections and magnets. This bottom insert allows for the easy removal and replacement of sachets, ensuring convenience for the user.

Additionally, a removable body insert is included, offering further organization with lower and slanted upper sections connected by side sections. The body insert features multiple channels for sachets and is secured within the base using magnets. An inner cap, secured within the lid, includes a well and a closure mechanism involving magnets, ensuring that the lid stays closed when not in use.

The design of this cosmetic case ensures that the lid can be easily opened when needed, thanks to a defined gap in the front portion of the case. This feature enhances the user experience, making it simple to access and replace sachets as needed. Overall, the case provides a compact and efficient solution for storing and organizing cosmetic sachets.

In another embodiment there is provided enhancements to the cosmetic case design, focusing on the secure attachment of the bottom insert and the body insert within the base. The bottom insert is secured to the bottom member of the base using a pair of diametrically extending end flanges and a pair of vertically extending side posts. These components engage with hooks and grooves on the bottom insert, ensuring a stable connection.

Furthermore, the body insert is secured within the base using magnets. The bottom insert magnet, positioned within an indented section of the bottom insert, attracts to the body insert lower magnet, located within an indentation on the underside of the body insert. This magnetic connection ensures that the body insert remains securely in place within the base, even during movement or transportation.

The closure mechanism of the inner cap is also detailed in these claims, involving magnets that maintain the lid closed against the base. The inner cap magnet and body insert magnet are designed to attract each other when the lid is closed, ensuring a secure closure. These enhancements enhance the overall functionality and usability of the cosmetic case, providing a secure and organized storage solution for cosmetic sachets.

In another embodiment of the invention there is defined the cosmetic case, focusing on the magnetic closures and attachment mechanisms. The case includes a bottom insert with a magnet secured within an indented section, and a body insert with a lower magnet secured within an indentation on its underside. These magnets ensure a secure attachment between the inserts and the base, preventing accidental dislodging during use.

Additionally, the closure mechanism of the inner cap is detailed, involving an inner cap magnet positioned within the front surface of the inner cap. This magnet attracts to a body insert upper magnet positioned within a frontmost channel of the body insert. This magnetic attraction ensures that the inner cap remains securely closed when the lid is in the closed position, providing a reliable closure mechanism for the case.

The design of the cosmetic case ensures that the contents are securely stored and easily accessible when needed. The combination of magnetic closures and secure attachment mechanisms provides a reliable and user-friendly storage solution for cosmetic sachets, making it ideal for both personal and professional use.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
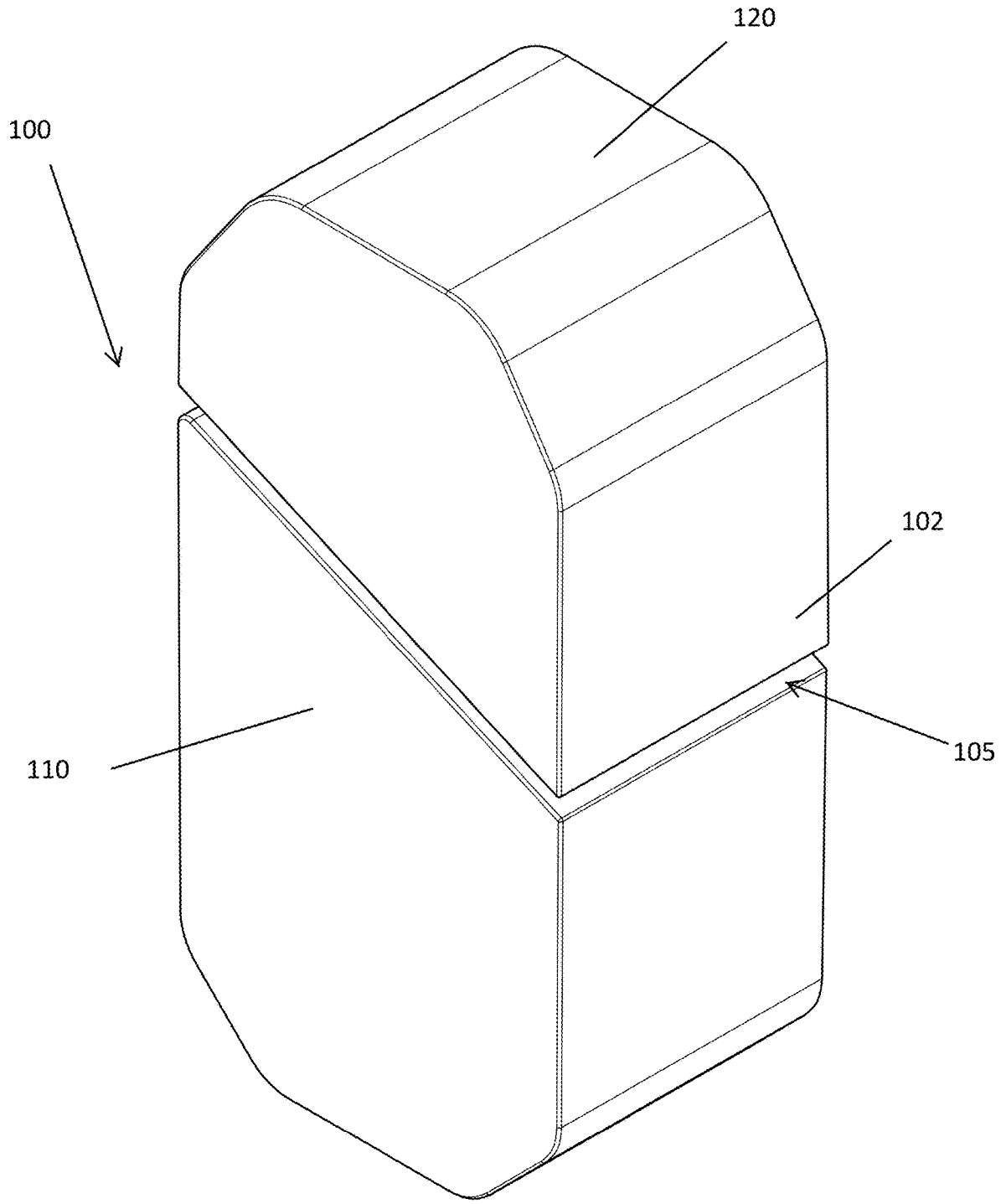
FIG. 1 is a perspective view of the cosmetic case in accordance with an embodiment of the invention illustrated in a closed configuration.
Figure 2:
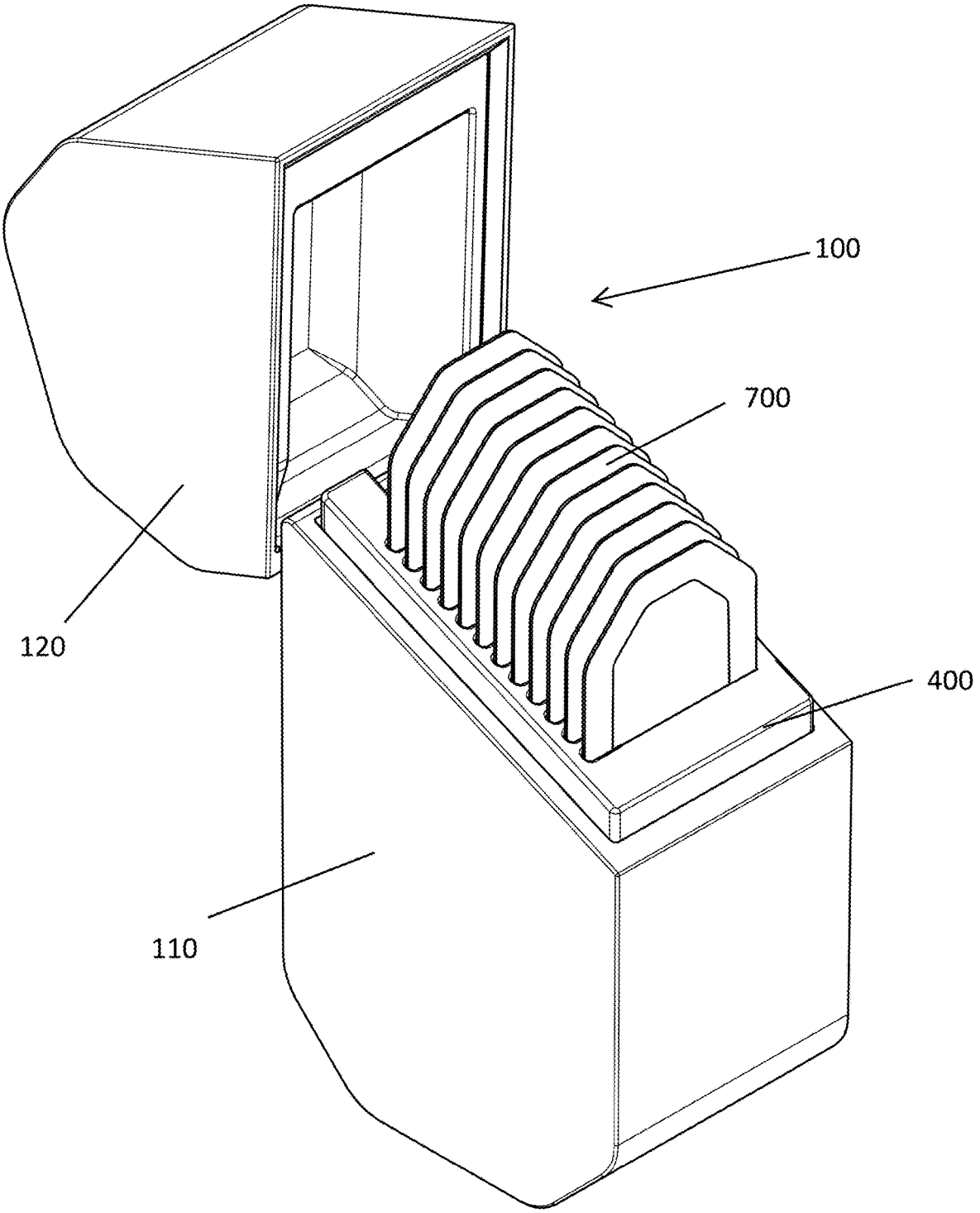
FIG. 2 is a perspective view of FIG. 1 with the cosmetic case in an open configuration.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Referring now to the figures, FIGS. 1 through 17, there is shown a cosmetic case 100. The case includes a base 110 connected to a lid 120 by a hinge mechanism 130 along the rear portion of the case 100. The hinge mechanism 130 is created by hinge pin 135 secured along the rear portion of the base 110 that is captured or secured to a hinge hook 138 on the rear portion of the lid 120. FIG. 1 shows the cosmetic case in a closed configuration 105.

The case 100 includes a base 110 that defines a front base portion 200 and a rear base portion 210. The rear base portion 210 includes an indentation 215 along a center section 220 thereof and which includes the hinge pin 135 secured about the center section 220. The base 110 includes exterior surface walls 230 that extend from a bottom member 235, that further defines an interior hollow section 240. The bottom member 235 includes a pair of diametric extending end flanges 245 that extend horizontally towards into the interior hollow section 240 and includes a pair of vertically extending side posts 250, that rest against the interior of the exterior surface walls 230.

Figure 6:
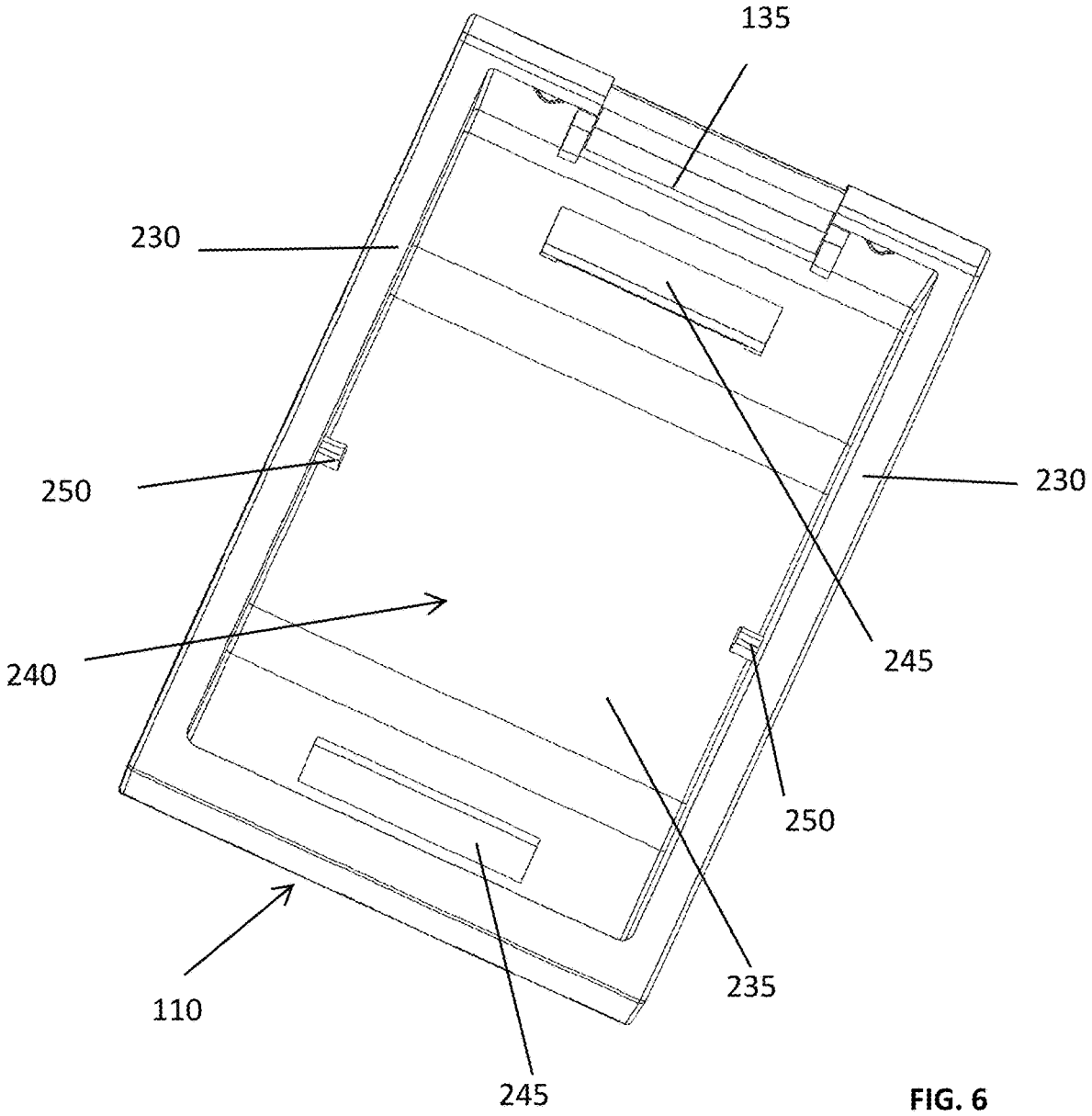
FIG. 6 is a top view of the base for the cosmetic case.
Figure 7:
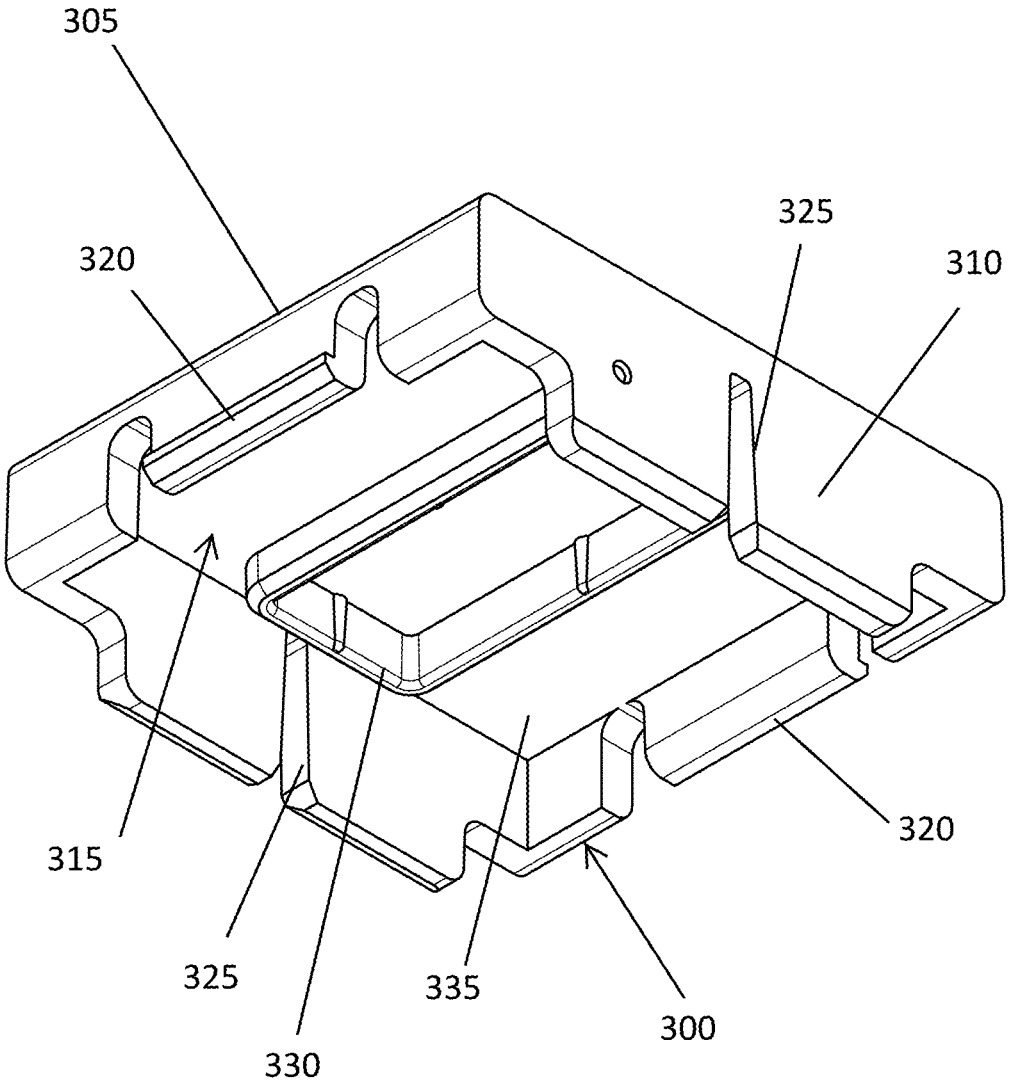
FIG. 7 is a perspective view of the bottom insert for the cosmetic case.
Figure 8:
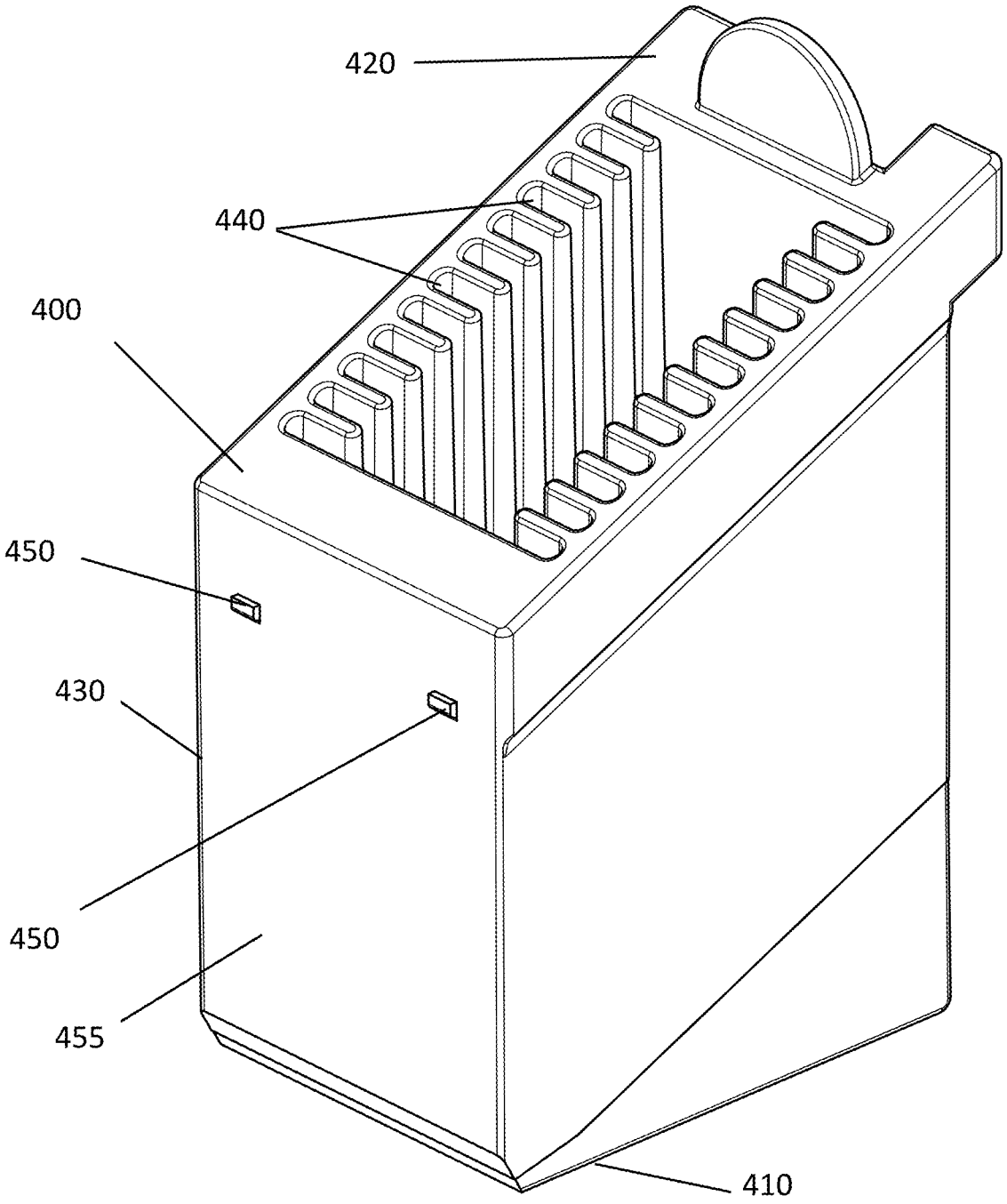
FIG. 8 is a perspective view of the insert body for the cosmetic case.
Figure 9:
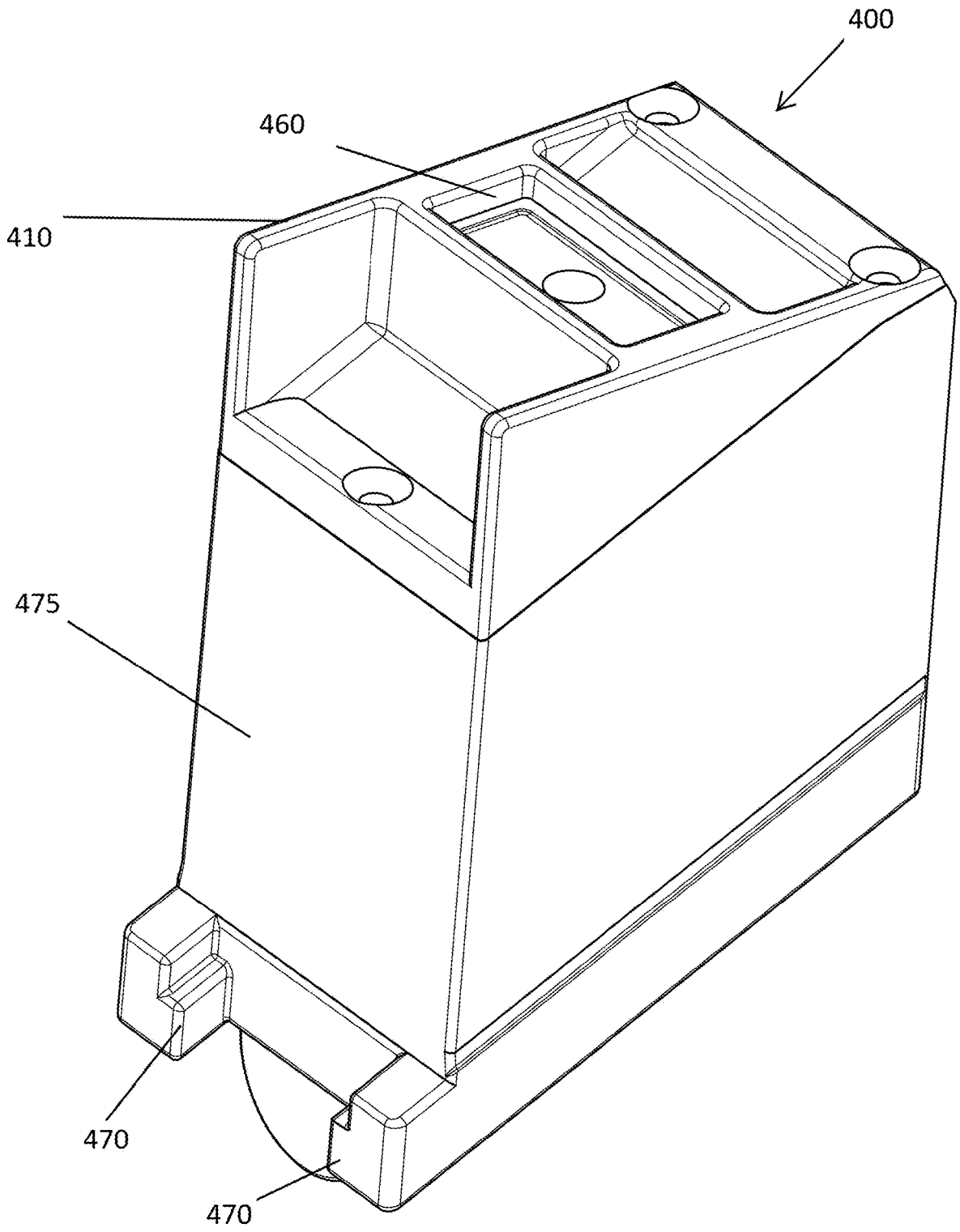
FIG. 9 is a underneath perspective view of the insert body for the cosmetic case.
Figure 10:
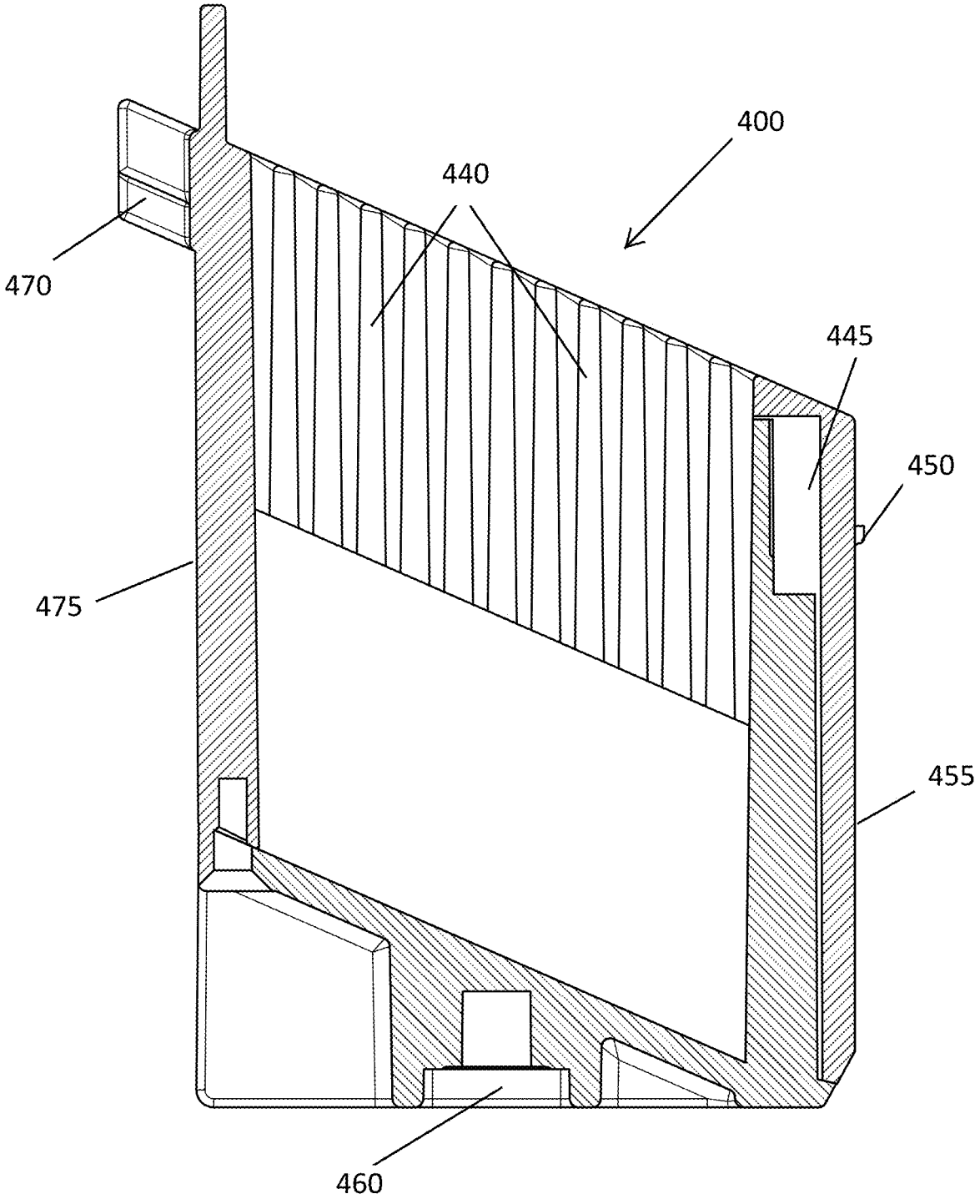
FIG. 10 is a sectional view of the insert body for the cosmetic case.
Figure 11:
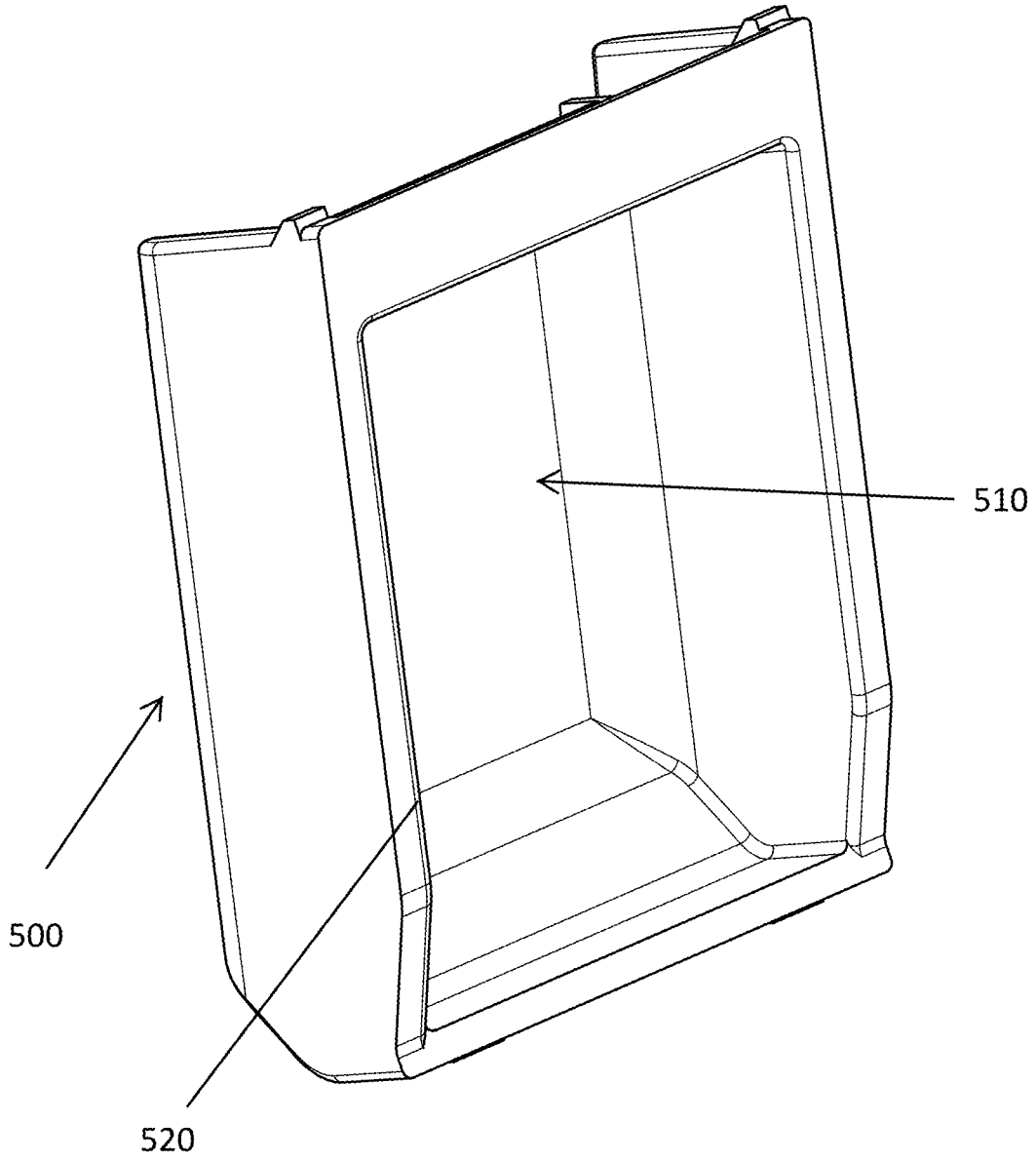
FIG. 11 is a perspective view of the inner cap for the cosmetic case.
Figure 12:
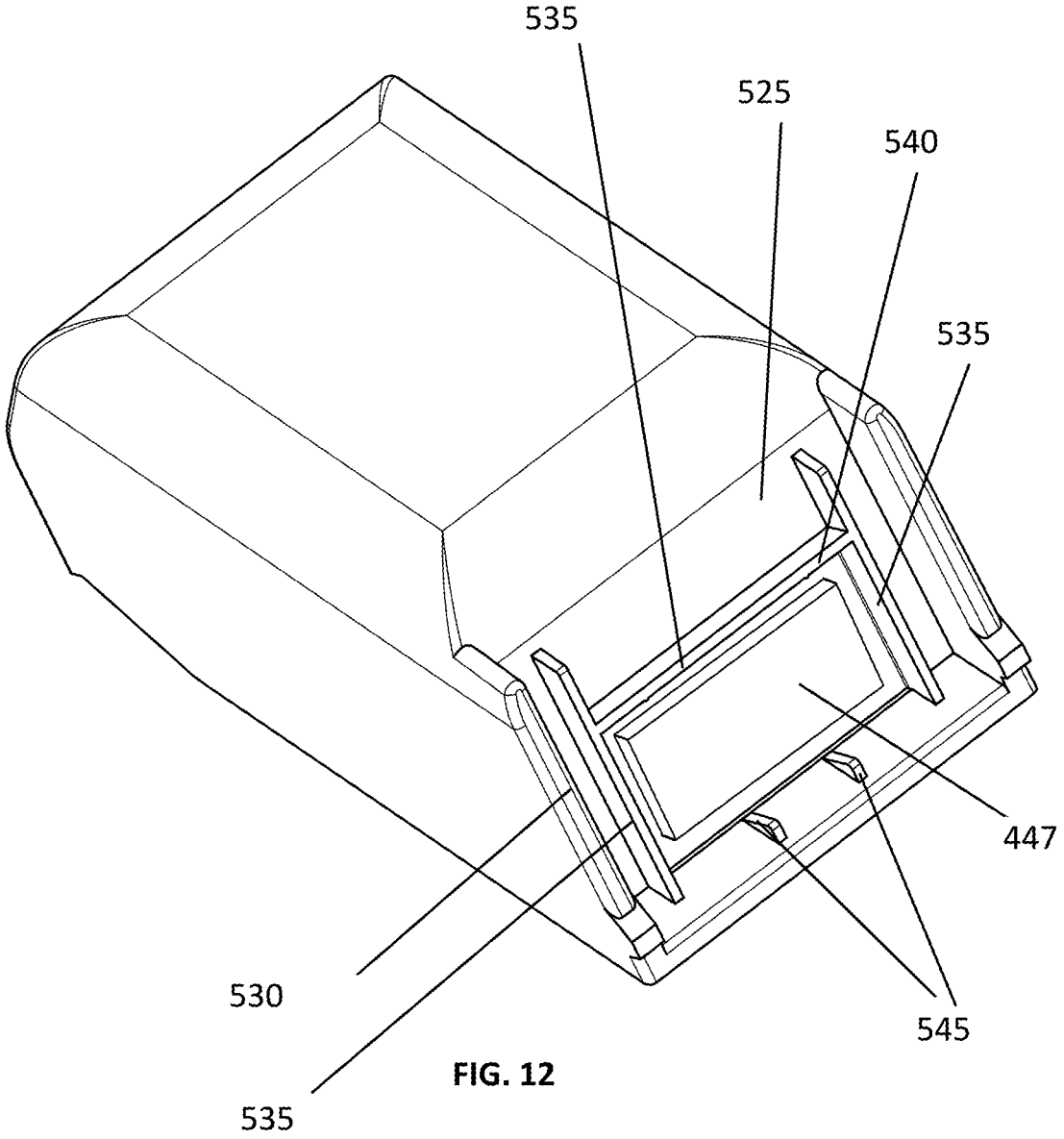
FIG. 12 is a perspective view of the underside of the inner cap for the cosmetic case.
Figure 13:
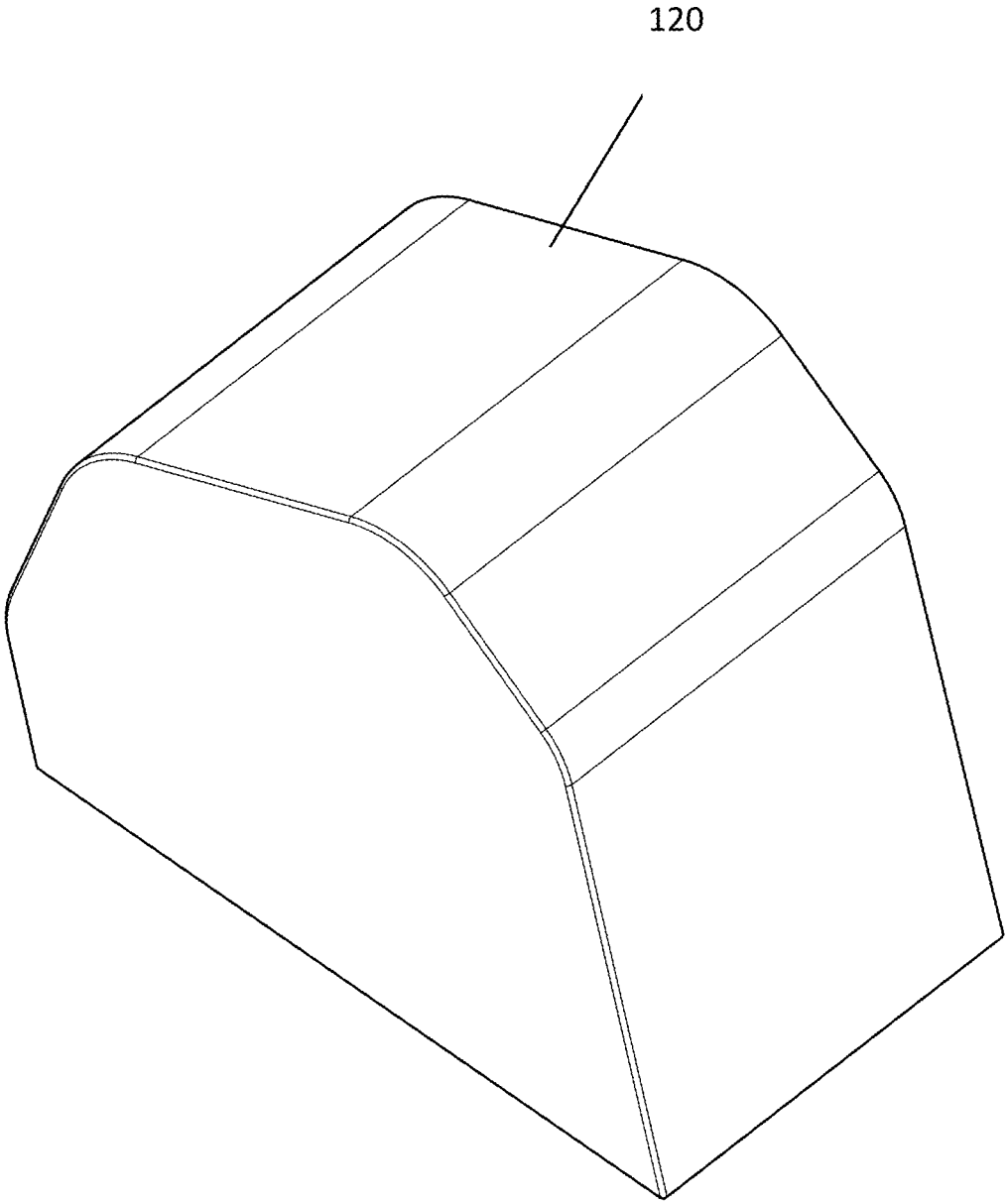
FIG. 13 is a perspective view of the lid for the cosmetic case.
Figure 14:
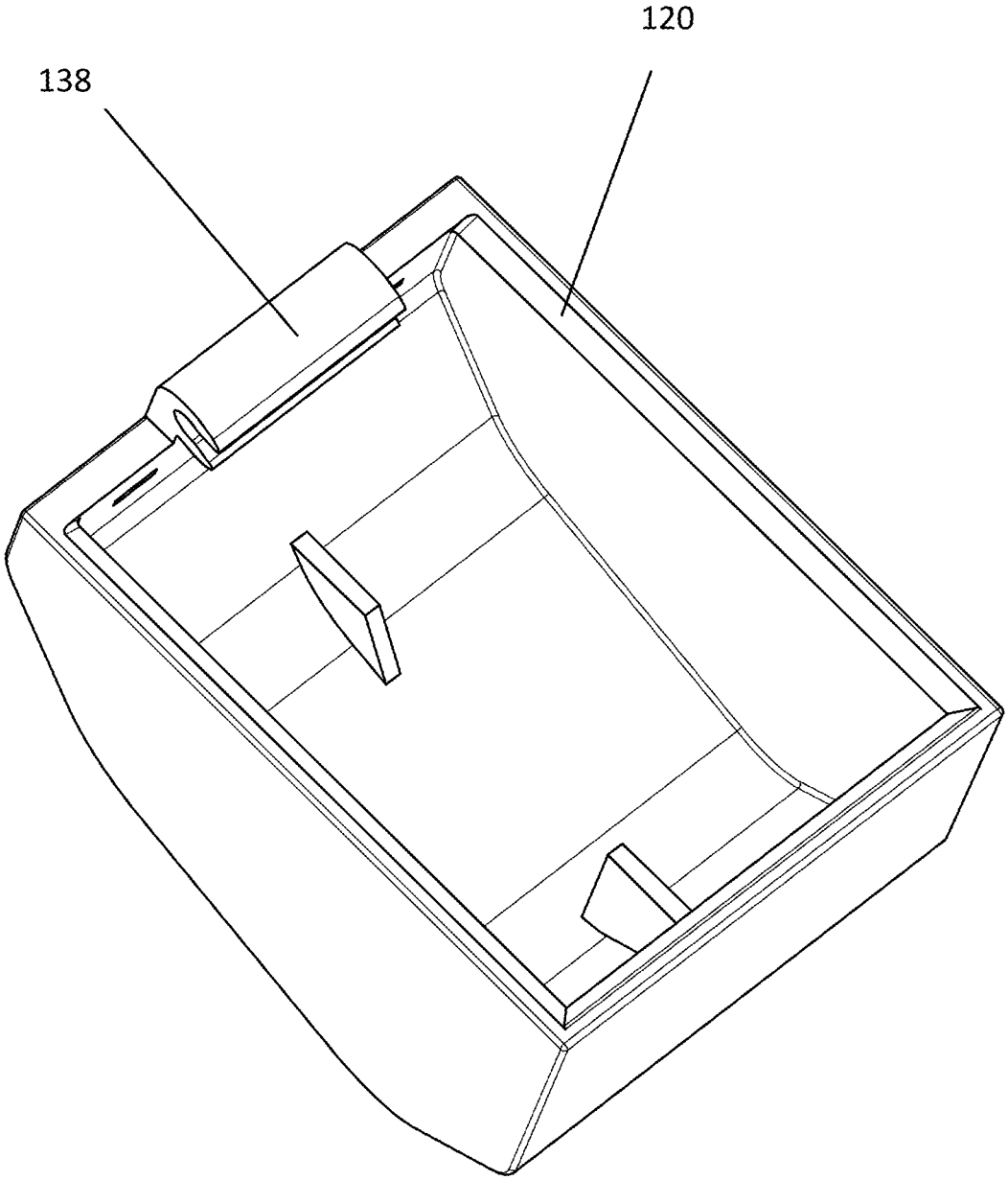
FIG. 14 is a perspective view of the lid for the cosmetic case.
Figure 15:
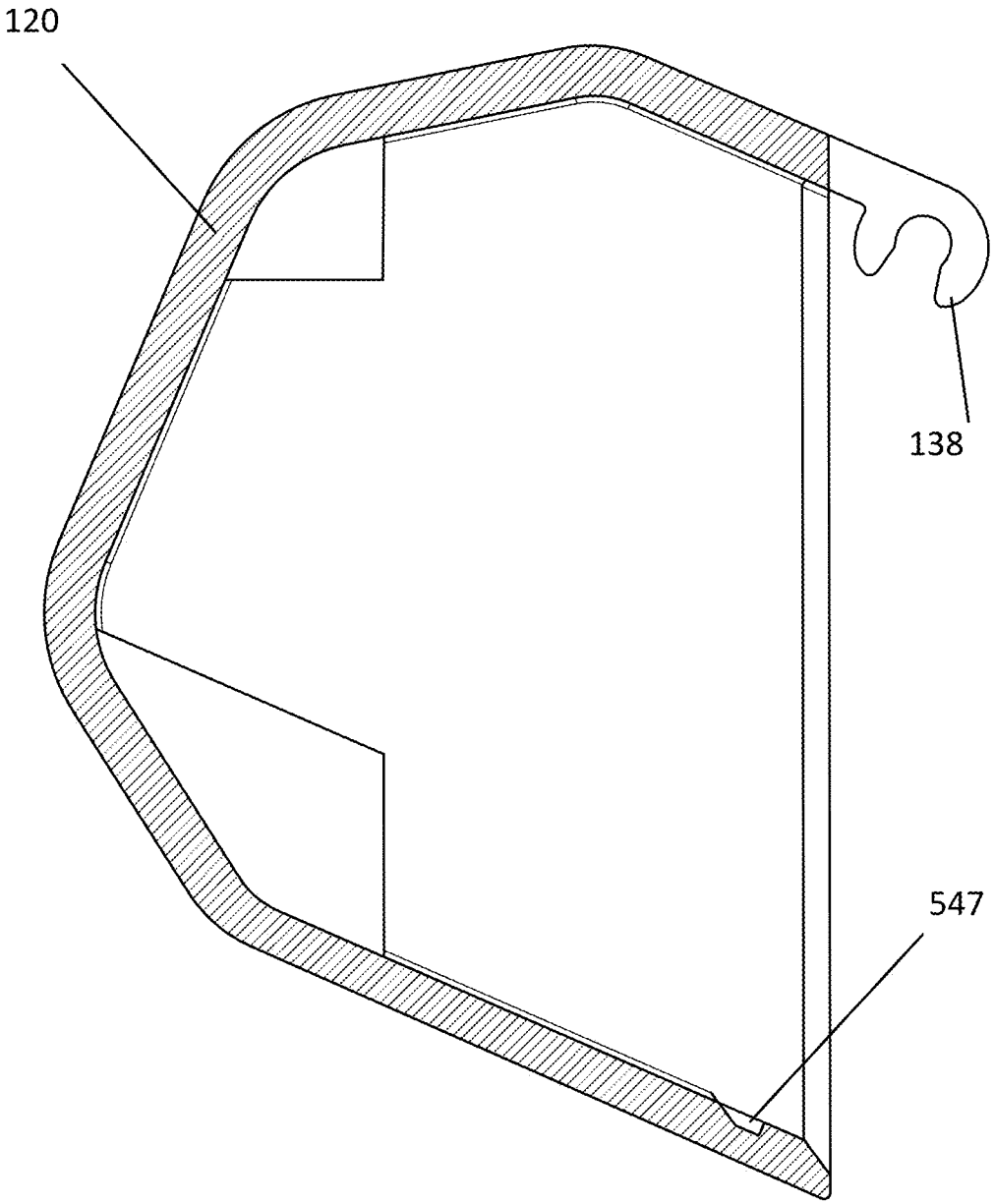
FIG. 15 is a sectional view of the lid for the cosmetic case.
Figure 16:
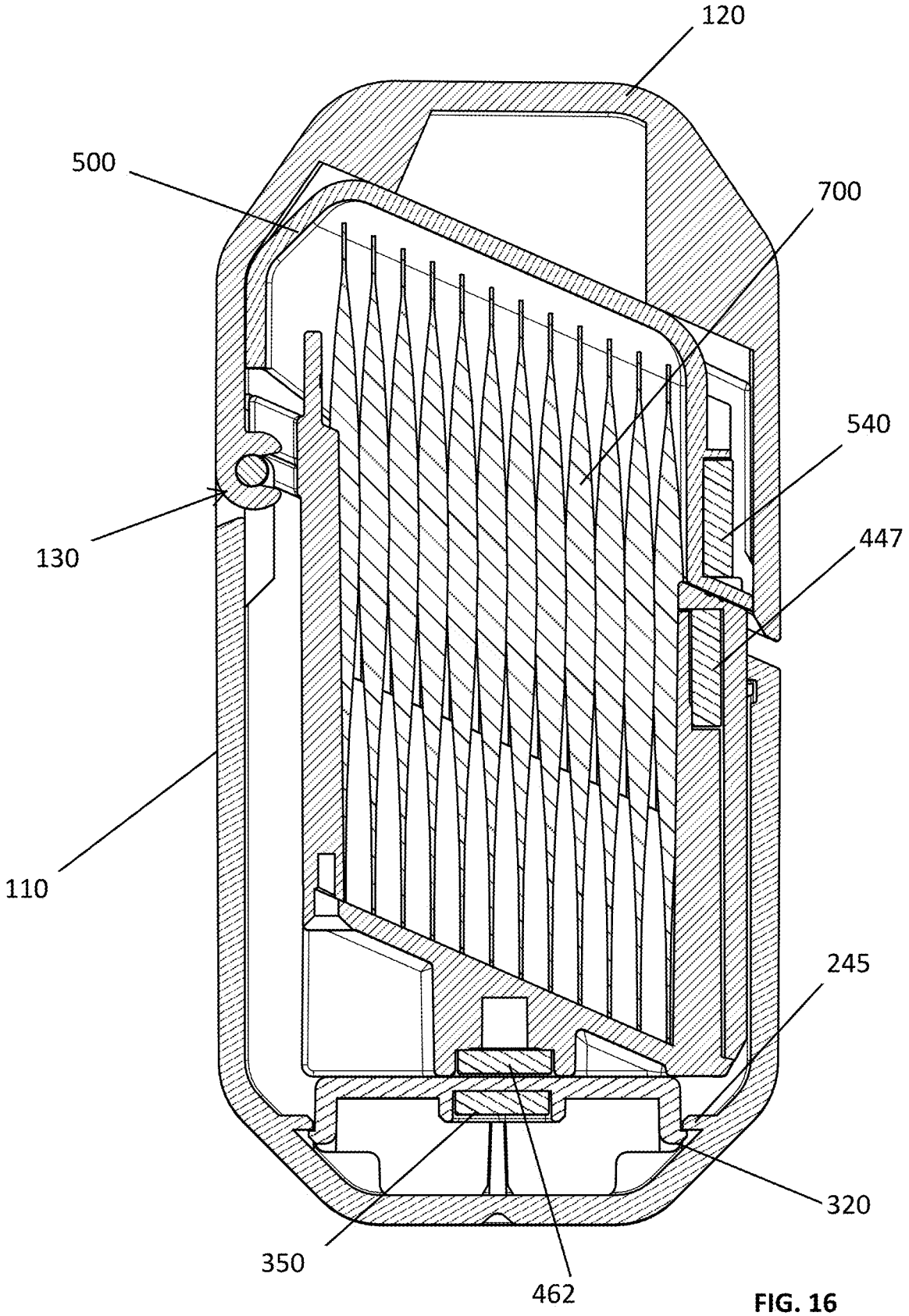
FIG. 16 is a sectional view of the cosmetic case.

The case 100 includes a bottom insert 300, which in FIG. 6 is illustrated in an upside down position. The bottom insert 300 includes a substantially flat top 305. The bottom insert 300 includes side walls 310 extending from the edge of the flat top 305 which defines a bottom well 315 positioned between the side walls 310 and which will fact the bottom member 235 when the bottom insert 300 is positioned within the interior hollow section 240 of the base 110. The bottom insert 300 further includes a pair of diametrically opposed hooks 320 on the ends of thereof and configured to grab and hook onto the diametric extending end flanges 245 of the base 110. The bottom insert 300 further includes grooves 325 positioned on the sides thereof and configured to align with and receive the pair of vertically extending side posts 250. In addition, the bottom insert 300 includes a indented section 330 along an interior portion 335 of the flat top 305. A bottom insert magnet 350 is positioned and secured within the indented section 330.

The case 100 further includes a removable body insert 400. The body insert 400 has a body insert lower section 410 and a body insert slanted upper section 420 which are connected to each other by body side sections 430. The body insert 400 includes a plurality of channels 440 configured through the body upper section 420 and extending through the interior of the body insert 400 towards the body lower section 410. It is possible that the channels are only formed partially through the interior of the body insert 400. The channels 440 are sized and configured to receipt removable/replaceable cosmetic sachets 700. The body insert 400 further includes a pair of flanges 450 positioned along a front surface 455. Along the underside of the body lower section 410 of the body insert 400 is an body insert indentation 460 that is configured to receive a body insert lower magnet 462. In addition, the body insert 400 includes an upper body section magnet 445 positioned adjacent the corner of the body upper section 420 and the front surface 455. When assembled the body insert lower magnet 462 attracts to the bottom insert magnet 350 which helps secures the body insert 400 within the base 110. However, if needed the two components can be separated and a first body insert 400 can be replaced with a second body insert. This can help to replace the sachets when used. The body insert 400 further includes a pair of diametrically facing ledges 470 positioned along the rear surface 475 adjacent the body insert slanted upper section.

Figure 3:
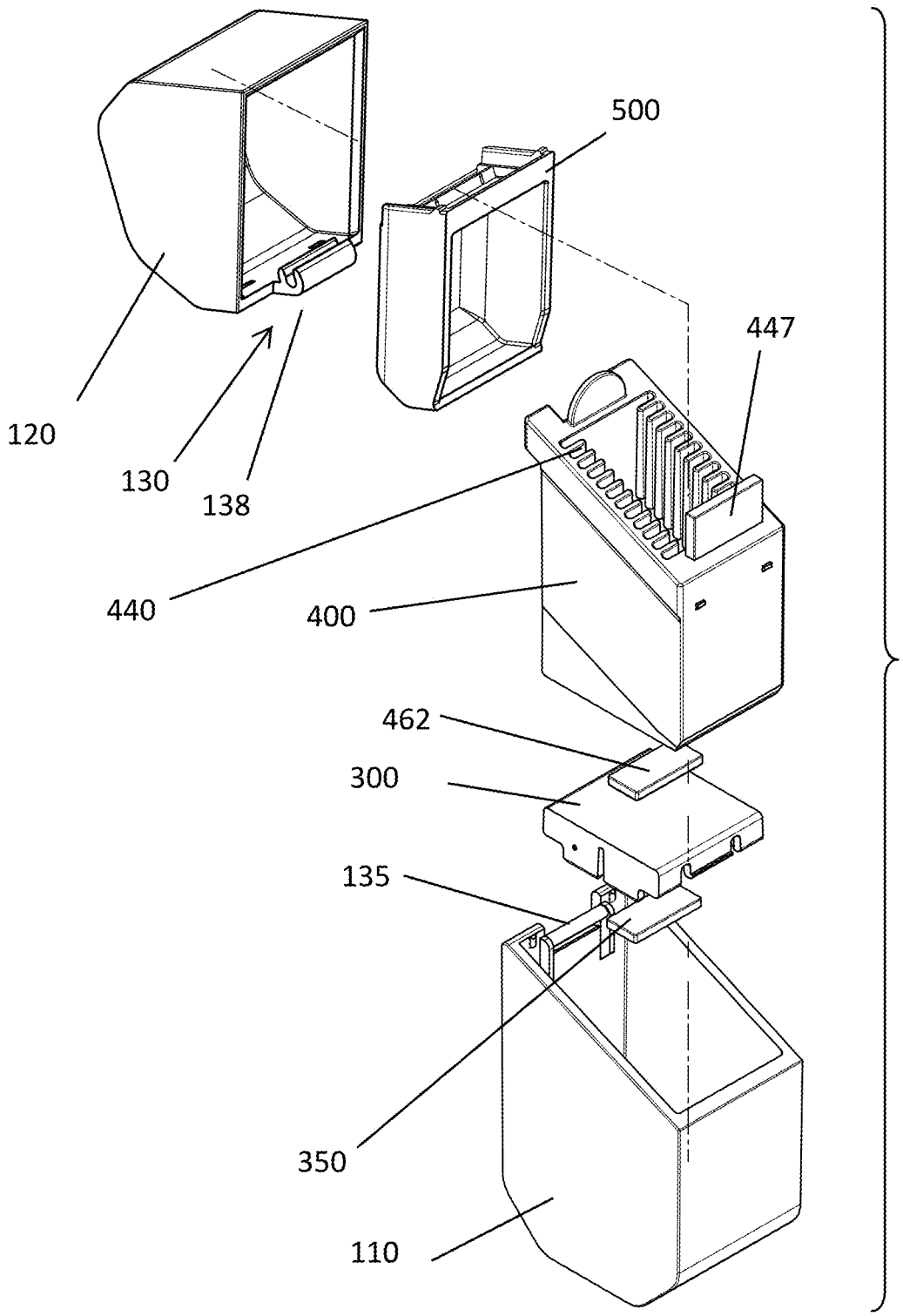
FIG. 3 is a perspective view of the cosmetic case in an exploded view.
Figure 4:
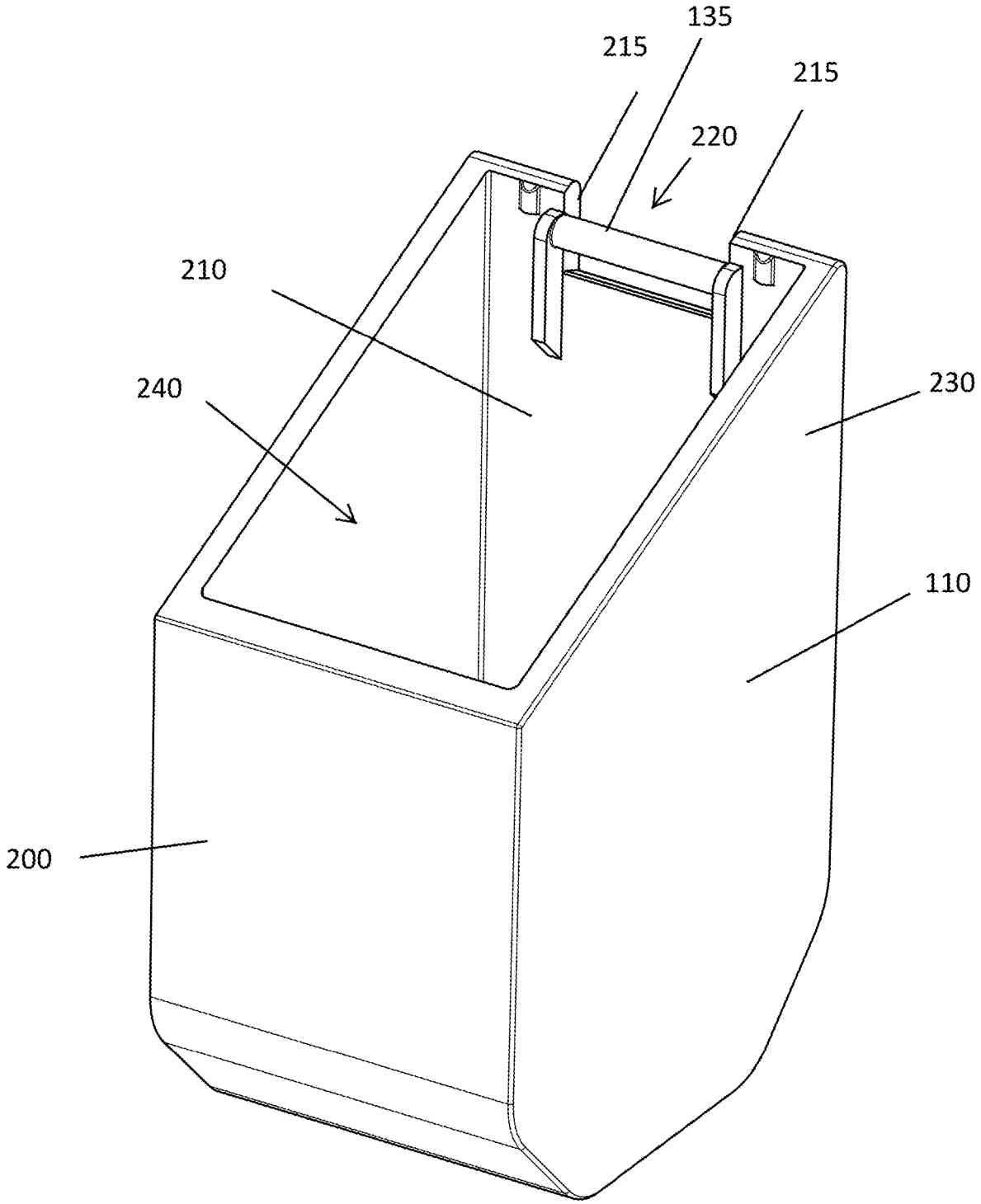
FIG. 4 is a perspective view of the base for the cosmetic case.
Figure 5:
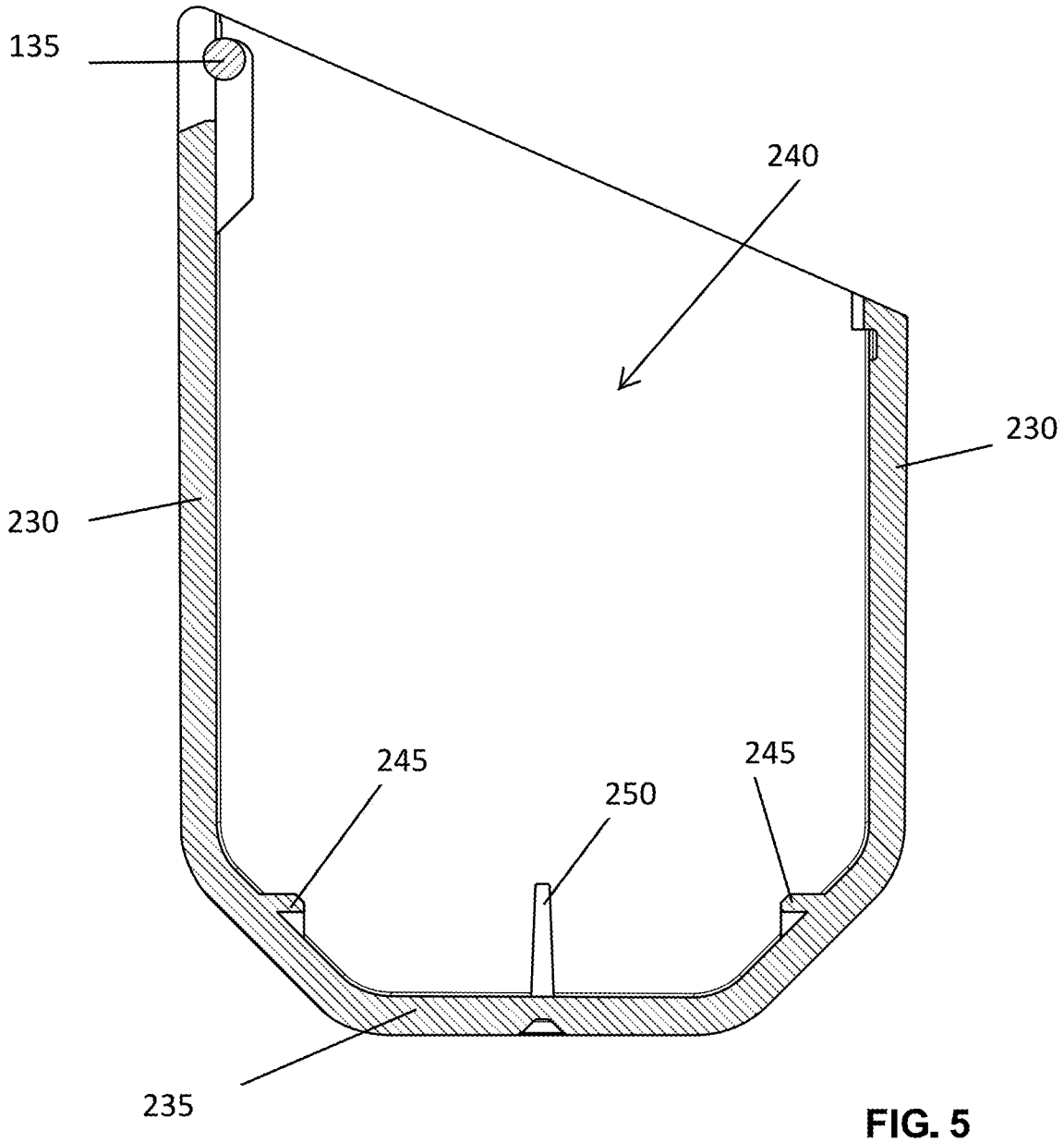
FIG. 5 is a sectional view of the base for the cosmetic case.

The case 100 includes an inner cap 500 that secured within the lid 120. The inner cap 500 includes a well 510 defined within inner cap surface walls 520. Along the exterior portion 525 of the front surface 530 of the inner cap 500 are channel walls 535 sized to create an interior notch 540 that is configured and sized to receive an inner cap magnet 447 (FIG. 3). The inner cap 500 includes a pair of inner cap flanges 545.

As noted above, the case 100 include a lid 120 that secures to the base 110 and that secures over the body insert 400 to create a small compact cosmetic case. The lid 120 further includes a pair of indentions 547 sized and configured to receive the pair of inner cap flanges 545 to help secure the inner cap 500 within the lid 120.

When fully assembled there is a small defined gap 108 in the front portion 102 of the case 100 between the lid 120 and base 110 that would allow the user to insert a finger tip to pull the lid 120 from the base 110 and open the case 100.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. A cosmetic case for holding at least one sachet, comprising a base including a front base portion and a rear base portion, the base including a bottom member with exterior base surface walls extending from the bottom member to define an interior hollow section, a lid connected by a hinge to the base;

a bottom insert positioned within the interior hollow section of the base, and secured to the bottom member of the base;

a removable body insert removably secured within the base, the removable body insert having a lower section and a slanted upper section connected by body side sections, the removable body insert including a plurality of channels extending through the body upper section towards the body lower section and configured to receive removable cosmetic sachets, an inner cap secured within the lid, the inner cap having a well defined within inner cap surface walls, and wherein the inner cap includes a closure mechanism configured to maintain the lid in a closed position against the base and allow the lid to move to an open position; and wherein when the lid is in a closed position there is a defined gap in the front portion of the case between the lid and the base to allow the lid to be moved to the open position.

2. The cosmetic case for holding at least one sachet of claim 1, wherein the bottom insert is secured to the bottom member by a pair of diametrically extending end flanges and a pair of vertically extending side posts extending from the bottom member of the base, which secure to a pair of diametrically opposed hooks configured to engage the pair of diametrically extending end flanges of the base and grooves configured to receive the pair of vertically extending side posts.

3. The cosmetic case for holding at least one sachet of claim 1, wherein the removable body insert is removably secured within the base by further including a bottom insert magnet secured within an indented section along an interior portion of a flat top of the bottom insert and a body insert lower magnet secured within a body insert indentation positioned along an underside of a lower section of the body insert, such that the bottom insert magnet attracts to the removable body insert lower magnet to secure the two together.

4. The cosmetic case for holding at least one sachet of claim 1, wherein the closure mechanism is defined by including an inner cap magnet positioned along an exterior portion of a front surface of the inner cap, the inner cap magnet being positioned to attract to a body insert magnet positioned in an upper portion of the removable body insert such that when the lid is moved to the closed position the inner cap magnet and the body insert magnet attract to keep the lid closed.

5. The cosmetic case for holding at least one sachet of claim 1, wherein the bottom insert includes a pair of diametrically opposed hooks configured to engage the pair of diametrically extending end flanges of the bottom member.

6. The cosmetic case for holding at least one sachet of claim 1, wherein the inner cap closure mechanism includes a pair of inner cap flanges that engage corresponding indentations in the lid to maintain the lid in a closed position against the base.

7. The cosmetic case for holding at least one sachet of claim 1, wherein the removable body insert includes a pair of flanges positioned along a front surface to assist in securing the removable body insert within the base.

8. The cosmetic case for holding at least one sachet of claim 1, wherein the removable body insert further includes a pair of diametrically facing ledges positioned along the rear surface adjacent to the slanted upper section, configured to enhance the stability of the removable body insert within the base.

9. A cosmetic case for holding at least one sachet, comprising:

a base having a front portion and a rear portion, and the base further having exterior walls extending from a bottom member to define an interior hollow section;

a lid connected by a hinge to the base;

a bottom insert positioned within the interior hollow section and secured to the bottom member by a pair of diametrically extending end flanges and a pair of vertically extending side posts, with the bottom insert having a pair of diametrically opposed hooks engaging the end flanges and grooves receiving the pair of vertically extending side posts, further including a bottom insert magnet secured within an indented section along an interior portion of a flat top of the bottom insert;

a removable body insert secured within the base, having lower and slanted upper sections connected by side sections, with channels for removable cosmetic sachets, and a body insert lower magnet secured within a body insert indentation positioned along an underside of a lower section of the removable body insert, the bottom insert magnet attracting to the body insert lower magnet to secure the removable body insert within the base;

an inner cap within the lid, having a well defined by inner cap surface walls and having a closure mechanism to maintain the lid in a closed configuration or an open configuration, the closure mechanism including an inner cap magnet positioned within an exterior portion of a front surface of the inner cap, and a body insert magnet positioned in an upper portion of the removable body insert, the body insert magnet configured to attract to the inner cap magnet when the lid is moved to the closed position; and a gap in the front of the case between the lid and base to facilitate opening the lid.

10. The cosmetic case for holding at least one sachet of claim 9, wherein the bottom insert is secured to the bottom member by a pair of diametrically extending end flanges and a pair of vertically extending side posts extending from the bottom member of the base, which secure to a pair of diametrically opposed hooks configured to engage the pair of diametrically extending end flanges of the base and grooves configured to receive the pair of vertically extending side posts.

11. The cosmetic case for holding at least one sachet of claim 10, wherein the bottom insert includes a pair of diametrically opposed hooks configured to engage the pair of diametrically extending end flanges of the bottom member.

12. The cosmetic case for holding at least one sachet of claim 11, wherein the inner cap closure mechanism includes a pair of inner cap flanges that engage corresponding indentations in the lid to maintain the lid in a closed position against the base.

13. The cosmetic case for holding at least one sachet of claim 12, wherein the removable body insert includes a pair of flanges positioned along a front surface to assist in securing the removable body insert within the base.

14. The cosmetic case for holding at least one sachet of claim 13, wherein the removable body insert further includes a pair of diametrically facing ledges positioned along the rear surface adjacent to the slanted upper section, configured to enhance the stability of the removable body insert within the base.

15. A cosmetic case comprising:

a base having a front portion and a rear portion, and the base further having exterior walls extending from a bottom member to define an interior hollow section;

a lid hinged to the base;

a bottom insert within the interior hollow section that is secured to the base, the bottom insert having a bottom insert magnet;

a removable body insert in the base, with lower and slanted upper sections connected by side sections, and having channels sized for sachets, the removable body insert having a body insert lower magnet and a body insert upper magnet;

an inner cap in the lid, with a well and a closure mechanism, the closure mechanism including a inner cap magnet;

wherein the inner cap magnet and body insert upper magnet are magnetically attracted to each other to secure the case in a closed configuration; and the body insert lower magnet and bottom insert magnet are magnetically attracted to each other to secure the removable body insert within the base.

16. The cosmetic case for holding at least one sachet of claim 15, wherein the bottom insert magnet is secured within an indented section along an interior portion of a flat top of the bottom insert and the body insert lower magnet is secured within a body insert indentation positioned along an underside of a lower section of the removable body insert.

17. The cosmetic case for holding at least one sachet of claim 16, wherein the body insert upper magnet is positioned within an upper portion of the removable body insert and the inner cap magnet is positioned within an exterior portion of a front surface of the inner cap.

18. The cosmetic case for holding at least one sachet of claim 17, wherein the bottom insert includes a pair of diametrically opposed hooks configured to engage diametrically extending end flanges of the bottom member.

* * * * *